US012440886B2

(12) United States Patent
Lee

(10) Patent No.: US 12,440,886 B2
(45) Date of Patent: Oct. 14, 2025

(54) VARIABLE DIE, AND PRESSING APPARATUS AND METHOD

(71) Applicant: POSCO Co., Ltd, Pohang-si (KR)

(72) Inventor: Jae-Wook Lee, Incheon (KR)

(73) Assignee: POSCO CO., LTD, Pohang-si (KR)

( * ) Notice: Subject to any disclaimer, the term of this patent is extended or adjusted under 35 U.S.C. 154(b) by 182 days.

(21) Appl. No.: 18/037,506

(22) PCT Filed: Nov. 2, 2021

(86) PCT No.: PCT/KR2021/015627

§ 371 (c)(1),
(2) Date: May 17, 2023

(87) PCT Pub. No.: WO2022/119144

PCT Pub. Date: Jun. 9, 2022

(65) Prior Publication Data

US 2024/0009727 A1 Jan. 11, 2024

(30) Foreign Application Priority Data

Dec. 1, 2020 (KR) ..... 10-2020-0165772

(51) Int. Cl.
*B21D 37/02* (2006.01)
*B21D 22/06* (2006.01)
(Continued)

(52) U.S. Cl.
CPC ..... *B21D 37/02* (2013.01)

(58) Field of Classification Search
CPC ..... B21D 37/02; B21D 37/04; B21D 37/12; B21D 22/06; B21D 5/0236; B21D 5/0281;
(Continued)

(56) References Cited

U.S. PATENT DOCUMENTS 9,174,260 B2 11/2015 Yusa
10,265,753 B2 4/2019 Yuasa
(Continued)

FOREIGN PATENT DOCUMENTS

JP S62-131738 U 8/1987
JP H08-001243 A 1/1996
(Continued)

OTHER PUBLICATIONS

English translate (WO2019130641A1), retrieved date Jan. 21, 2025.*
(Continued)

*Primary Examiner* — Mohammed S. Alawadi

(74) *Attorney, Agent, or Firm* — Morgan Lewis & Bockius LLP

(57) ABSTRACT

A variable die according to an embodiment of the present invention may comprise: a first lower die part; and a first upper die part disposed above the first lower die part, wherein: the first lower die part comprises a first lower die center part and a first lower die side part; the first lower die center part includes a first sensor unit which measures a distance; a first lower die side part includes an inner member having a slope, and a drive unit which moves the inner member toward the first lower die center part; the first sensor unit measures a forming distance which is the distance from the first sensor unit to a material; and the driver unit is driven on the basis of the forming distance to adjust a correction distance which is the moving distance of the inner member.

18 Claims, 8 Drawing Sheets

(51) Int. Cl.

| | |
|---|---|
| ***B21D 37/04*** | (2006.01) |
| ***B21D 37/12*** | (2006.01) |
| ***B30B 15/00*** | (2006.01) |
| ***B30B 15/04*** | (2006.01) |

(58) Field of Classification Search
CPC ..... B30B 15/0029; B30B 15/0041; B30B 15/041
See application file for complete search history.

(56) References Cited

U.S. PATENT DOCUMENTS

| | | | | |
|---|---|---|---|---|
| 2004/0020261 | A1* | 2/2004 | Tokuda ..... | B21D 22/02 72/334 |
| 2013/0316132 | A1 | 11/2013 | Yusa | |

FOREIGN PATENT DOCUMENTS

| | | | | |
|---|---|---|---|---|
| JP | H08-90086 | A | 4/1996 | |
| JP | H09-143508 | A | 6/1997 | |
| JP | 2005-219113 | A | 8/2005 | |
| JP | 2006-102797 | A | 4/2006 | |
| JP | 2014-4625 | A | 1/2014 | |
| KR | 20-1999-0038356 | U | 10/1999 | |
| KR | 10-0774703 | B1 | 11/2007 | |
| KR | 10-2010-0002958 | A | 1/2010 | |
| KR | 10-2012-0075704 | A | 7/2012 | |
| KR | 10-2015-0017935 | A | 2/2015 | |
| KR | 10-2178739 | B1 | 11/2020 | |
| WO | WO-2019130641 | A1 * | 7/2019 | ..... B21D 22/26 |

OTHER PUBLICATIONS

International Search Report dated Feb. 8, 2022, issued in International Patent Application No. PCT/KR2021/015627 (with English translation).
Office Action dated Sep. 10, 2024, issued in corresponding Japanese Patent Application No. 2023-530258.
Japanese Office Action dated May 14, 2024 issued in Japanese Patent Application No. 2023-530258.
Decision of Grant dated Mar. 11, 2025, issued in corresponding Japanese Patent Application No. 2023-530258 with an English translation.

* cited by examiner

VARIABLE DIE, AND PRESSING APPARATUS AND METHOD

CROSS-REFERENCE OF RELATED APPLICATIONS

This application is the U.S. National Phase under 35 U.S.C. § 371 of International Patent Application No. PCT/KR2021/015627, filed on Nov. 2, 2021, which in turn claims the benefit of Korean Application No. 10-2020-0165772, filed on Dec. 1, 2020, the disclosures of which applications are incorporated by reference herein.

TECHNICAL FIELD

The present disclosure relates to a variable die, and pressing apparatus and method.

BACKGROUND ART

In the automobile industry, the application of a bending method has increased due to the trend for high strength materials. Springback, inevitable in the bending of materials, is a phenomenon caused by complex causes, such as an elastic modulus of a material and a stress distribution in a thickness direction, and the like, and it is not easy to accurately predict and correct springback.

In the field of bending, attempts have been made to improve precision of product forming by predicting springback. For example, a method of adding a die to compensate for springback based on physical properties of a specific material has been used in the production process.

However, this method is not efficient because a separate die should be manufactured according to physical properties of materials. In addition, even with this method, a targeted springback correction effect may not be achieved.

That is, even if physical properties of a sample used to manufacture the die and physical properties of a material to be actually worked are the same, the target springback correction effect may not be achieved if a working environment is different.

For example, internal stress of a material, such as a high-strength coil steel sheet, before forming may be different from that of the sample due to a difference in a wound position or a wound tension, and due to this, the target springback correction effect may not be achieved even if the physical properties are the same.

(Patent Document 1) KR 10-2010-0002958 A

SUMMARY OF INVENTION

Technical Problem

An aspect of the present disclosure is to provide a variable die, a pressing apparatus, and a pressing method capable of changing forming conditions for correcting forming errors due to springback of a material.

An aspect of the present disclosure is also to provide a variable die, a pressing apparatus, and a pressing method capable of changing forming conditions in real time to correct springback of a material.

Solution to Problem

According to an aspect of the present disclosure, a variable die includes: a first lower die portion; and a first upper die portion disposed above the first lower die portion, wherein the first lower die portion includes: a first lower die center portion, on which a material is seated, and including a first sensor unit; and a first lower die side part installed on a side surface of the first lower die center portion, the first lower die side part includes: an inner member having an inclined surface close to the first lower die center portion from top to bottom; and a driving unit moving the inner member in a first direction, a direction toward the first lower die center portion, the first upper die portion includes: a first upper die center portion disposed above the first lower die center portion and moving downwardly toward the first lower die center portion; and a first upper die side part installed on a side surface of the first upper die center portion, moving downwardly, guided by the inclined surface when moving downwardly and rotatably moving to a side surface of the first lower die center portion, the first sensor unit measures a forming distance, a distance from the first sensor unit to the material, and the driving unit is driven based on the forming distance to adjust a correction distance, a moving distance of the inner member.

According to another aspect of the present disclosure, a pressing apparatus includes: a pressing body; a pre-die installed on the pressing body and primarily forming a material; and the variable die installed on the pressing body and secondarily forming the material, while correcting a forming error caused by springback.

According to another aspect of the present disclosure, a pressing method includes: a first pressing operation of forming a first material with a variable die under a forming condition determined by a first set distance; a forming distance measuring operation of measuring a first forming distance, a distance between the first material and a first sensor unit of the variable die; a set distance correcting operation of determining a second set distance, a set distance for a following round, based on a difference between the first set distance and the first forming distance; and a second pressing operation of forming a second material following the first material with the variable die under a forming condition determined by the second set distance.

Advantageous Effects of Invention

The variable die, pressing apparatus, and pressing method of the present disclosure have the advantage of changing forming conditions for correcting forming errors due to springback of a material.

In another aspect, the variable die, pressing apparatus, and pressing method of the present disclosure have the advantage of changing forming conditions in real time to correct springback of a material.

However, the various advantageous advantages and effects of the present disclosure are not limited to the above description, and will be more easily understood in the process of describing specific embodiments of the present disclosure.

BEST MODE FOR INVENTION

Figure 1:
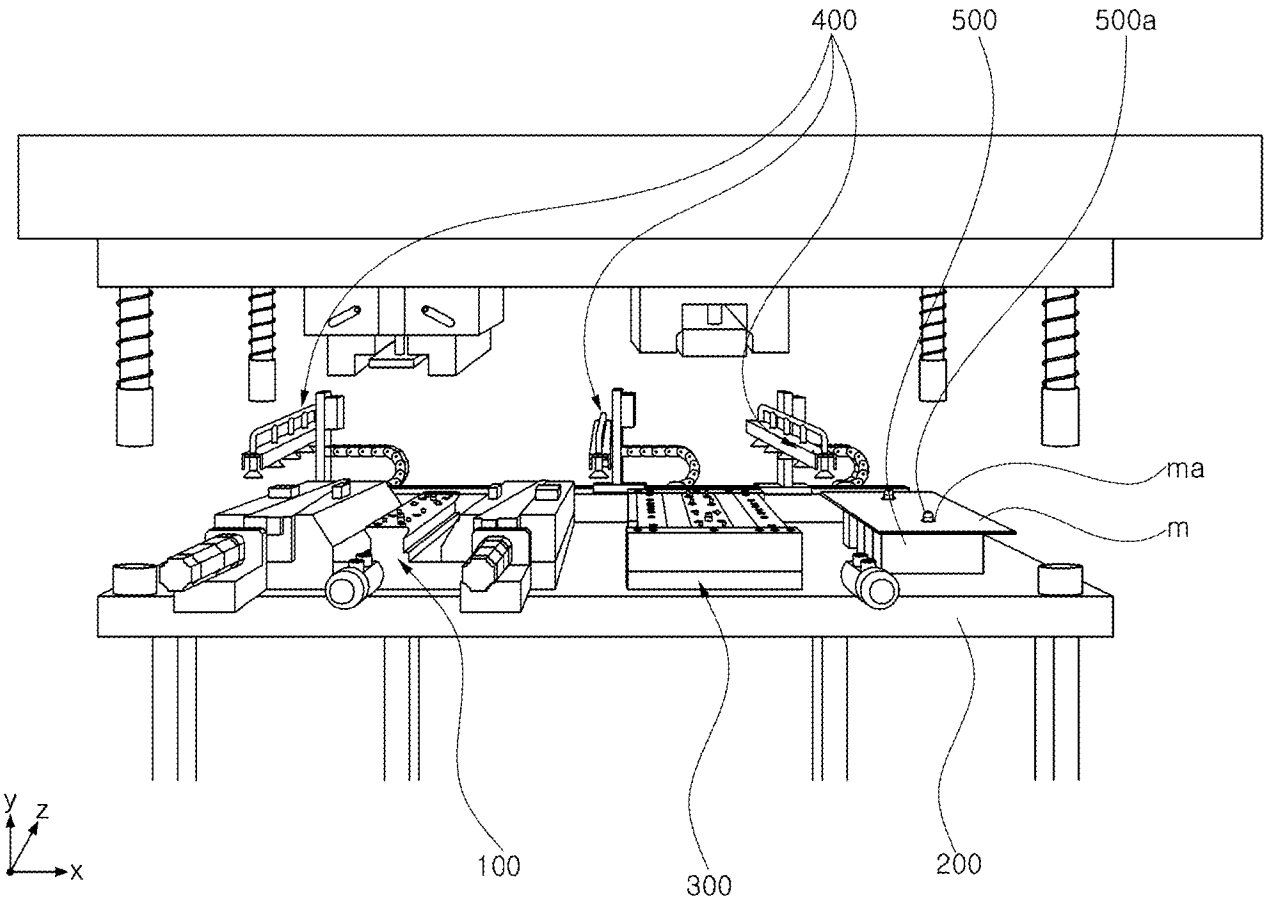
FIG. 1 is a perspective view illustrating a pressing apparatus according to an embodiment of the present disclosure.

Hereinafter, embodiments of the present disclosure will be described in detail with reference to the accompanying drawings. This disclosure may, however, be embodied in many different forms and should not be construed as limited to the embodiments set forth herein. Rather, these embodiments are provided so that this disclosure will be thorough and complete and will fully convey the scope of the disclosure to those skilled in the art. The shape and size of each element in the drawings may be exaggerated for clarification.

FIG. 1 is a perspective view illustrating a pressing apparatus according to an embodiment of the present disclosure. Referring to the drawing, a pressing apparatus may include a pressing body 200, a pre-die 300, and a variable die 100.

Here, the pressing body 200 serves as a body in which the pre-die 300 and the variable die 100 are installed. In addition, a position adjustment block 500 may be installed in the pressing body 200.

The position adjustment block 500 may have a second protruding tab 500*a* formed on an upper surface thereof and inserted into a position fixing hole ma formed in a material m. Here, the position adjustment block 500 may position the material m in a specific position by the second protruding tab 500*a*.

The pre-die 300 is installed on the pressing body 200, and the material m is primarily formed. The pre-die 300 will be described below with reference to FIG. 2.

The variable die 100 is installed on the pressing body 200, receives the material m primarily formed in the pre-die 300, and secondarily forms the material m, while correcting forming errors due to springback. The material m is secondarily formed. The variable die 100 will be described below with reference to FIGS. 3 to 7.

In addition, the pressing apparatus according to an embodiment of the present disclosure includes a transfer unit 400. The transfer unit 400 is installed on the pressing body 200, adsorbs and fixes the material m, and sequentially moves the material m to the position adjustment block 500, the pre-die 300, and the variable die 100.

The material m is always provided to the same position of the position adjustment block 500 by the second protruding tab 500*a*. Accordingly, the transfer unit 220 always starts moving the material m in the same position. Accordingly, a movement error of the material m may be improved.

Figure 2:
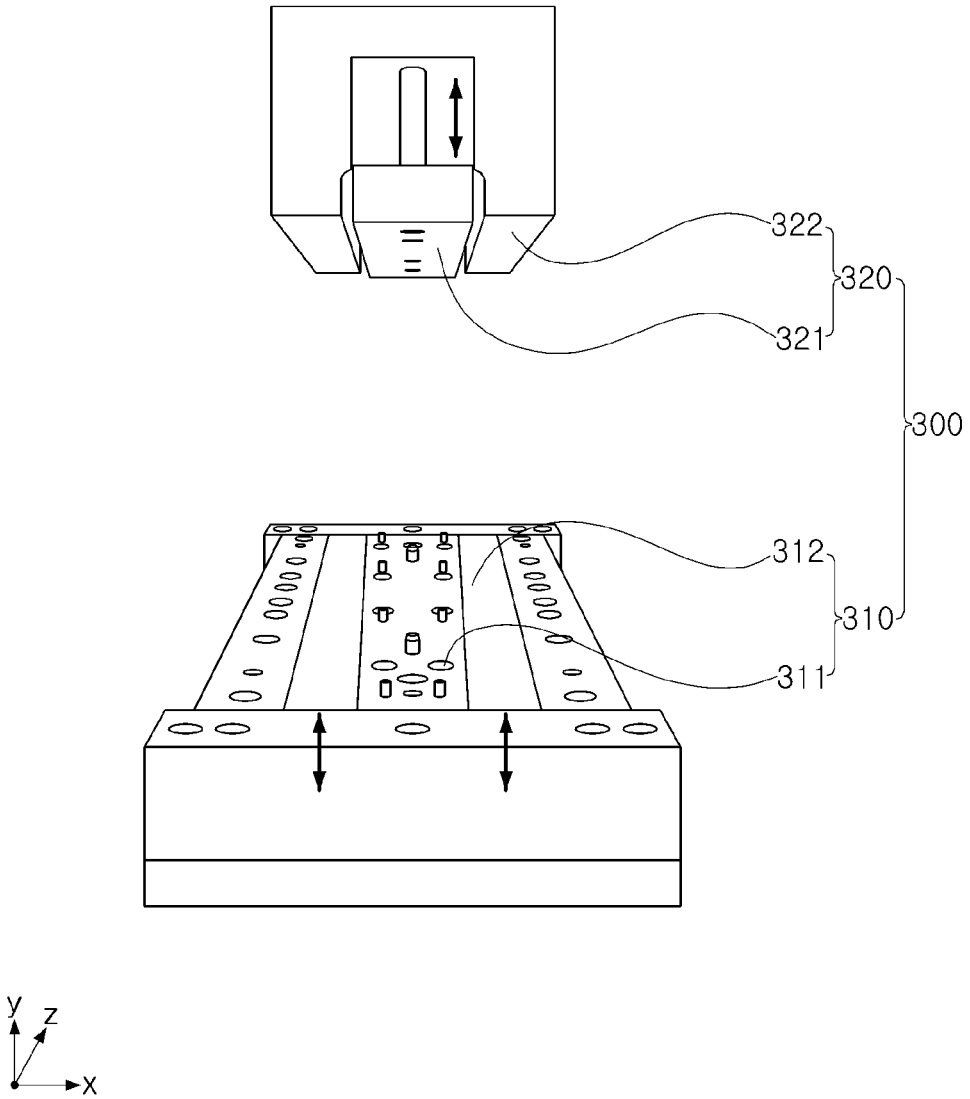
FIG. 2 is a perspective view illustrating a pre-die according to an embodiment of the present disclosure.

FIG. 2 is a perspective view illustrating the pre-die 300 according to an embodiment of the present disclosure. Referring to the drawing, the pre-die 300 includes a second lower die portion 310 and a second upper die portion 320.

The second lower die portion 310 includes a second lower die center portion 311 and a second lower die side part 312. The second lower die center portion 311 is a member fixed to a lower portion of the pressing body 200. The second lower die side part 312 is a member disposed outside the second lower die center portion 311 and receiving elastic force upwardly by an expansion spring or the like. In addition, the second lower die side part 312 is pressed downwardly to be moved downwardly as the second upper die portion 320 moves downwardly.

The second upper die portion 320 includes a second upper die center portion 321 and a second upper die side part 322. The second upper die center portion 321 is a member receiving an elastic force downwardly by an expansion spring or the like. After the second upper die center portion 321 is moved downwardly to contact an upper surface of the material m, the second upper die center portion 321 is pressed upwardly to be moved upwardly by the second lower die center portion 311. Also, the second upper die side part 322 is a member disposed outside the second upper die center portion 321 and fixed to an upper portion of the pressing body 200.

With this configuration, a central portion of the material m is fixed in close contact between the second upper die center portion 321 and the second lower die center portion 311. Both sides of the material m are formed while being bent toward a side surface of the second lower die center portion 311 by the second upper die side part 322 moved downwardly.

Figure 3:
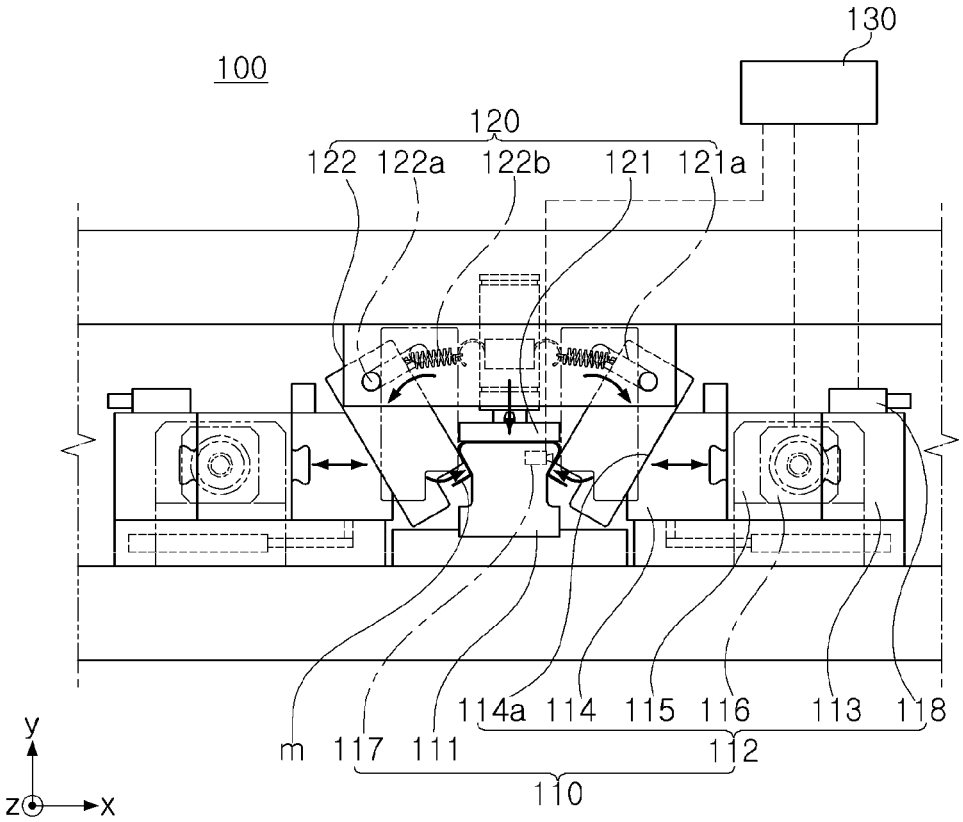
FIG. 3 is a front view illustrating a variable die according to an embodiment of the present disclosure.
Figure 4:
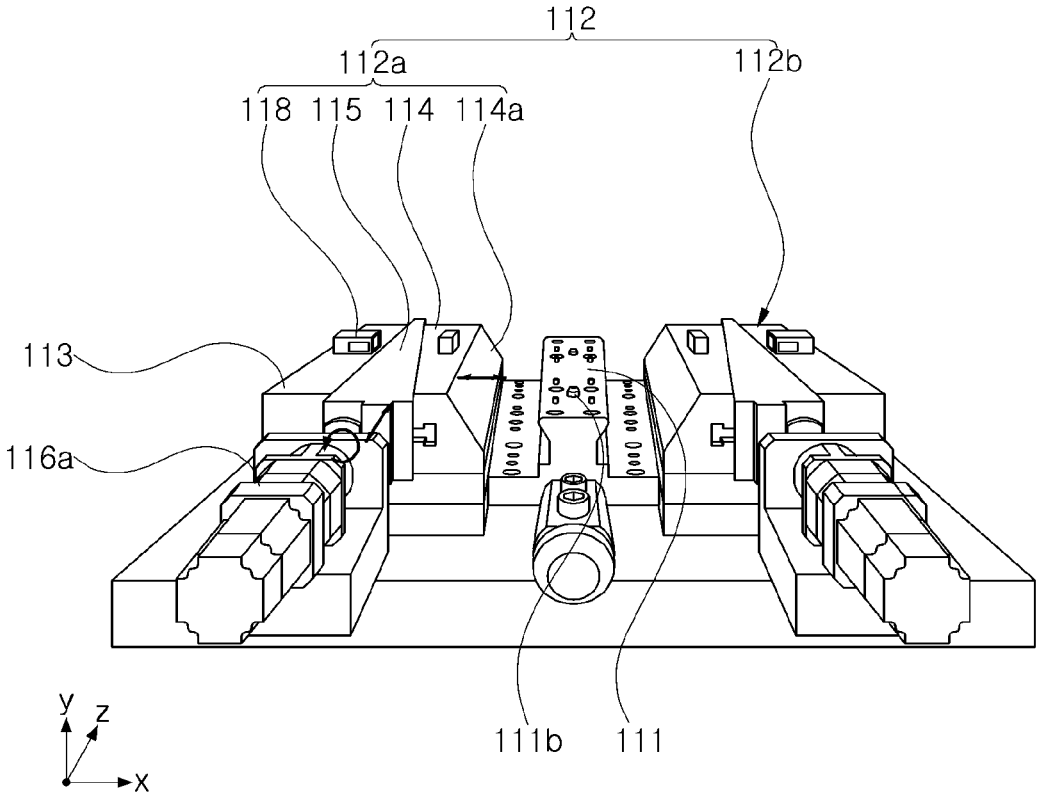
FIG. 4 is a perspective view illustrating a first lower die portion according to an embodiment of the present disclosure.
Figure 5:
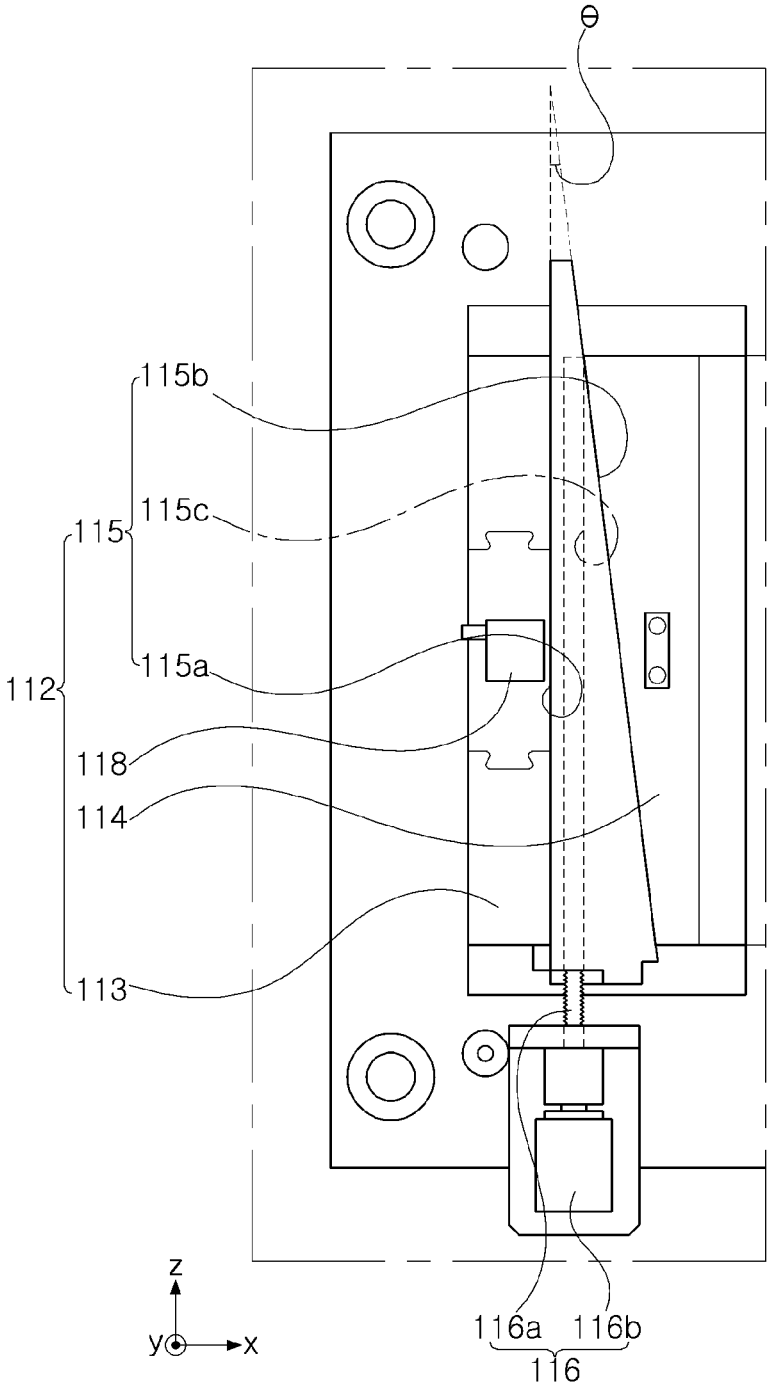
FIG. 5 is a plan view illustrating a first lower mode side part according to an embodiment of the present disclosure.

FIG. 3 is a front view illustrating the variable die 100 according to an embodiment of the present disclosure, and FIG. 4 is a perspective view illustrating a first lower die portion 110 according to an embodiment of the present disclosure. Also, FIG. 5 is a plan view illustrating a first lower die side part 112 according to an embodiment of the present disclosure.

Referring to the drawings, the variable die 100 may include the first lower die portion 110 and a first upper die portion 120.

Here, the first lower die portion 110 includes a first lower die center portion 111, a first lower die side part 112, and a second sensor unit 118.

The material m is seated on the first lower die center portion 111. A first sensor unit 117 is provided in the first lower die center portion. The first sensor unit 117 measures a forming distance B, a distance from the first sensor unit 117 to the material m. This will be described below with reference to FIGS. 6 and 7.

The first lower die side part 112 is installed on a side surface of the first lower die center portion 111. The first lower die side part 112 includes an inner member 114 and a driving unit 116.

The inner member 114 has an inclined surface 114*a* closer to the first lower die center portion 111 from top to bottom. Further, the driving unit 116 moves the inner member 114 in a first direction X, a direction of the first lower die center portion 111. The second sensor unit 118 measures a correction distance, a moving distance of the inner member 114.

In addition, the first lower die side part 112 according to an embodiment of the present disclosure may further include an outer member 113 and a wedge member 115. The outer member 113 is a member disposed outside the inner member 114. The wedge member 115 is disposed between the inner member 114 and the outer member 113. In addition, the wedge member 115 is linked to the driving unit 116, and is moved by the driving unit 116 in a second direction Z, a direction crossing the first direction X. Here, the driving unit 116 is driven based on the forming distance and adjusts the correction distance.

To this end, the wedge member 115 includes an outer surface 115*a* and an inner surface 115*b*. The outer surface 115*a* contacts the outer member 113 and is formed to be horizontal to the second direction Z. The inner surface 115*b* is in contact with the inner member 114 and is inclined in the second direction Z.

By the movement of the wedge member 115 in the second direction Z, the inner member 114 moves in the first direction X.

In addition, the wedge member 115 finely adjusts a moving distance of the inner member 114 according to the degree of being sandwiched between the outer member 113 and the inner member 114. To this end, a wedge angle θ, an angle formed between the outer surface 115*a* and the inner surface 115*b* of the wedge member 115 according to an embodiment of the present disclosure, is formed to be smaller than at least degrees. That is, by forming the wedge angle θ to be smaller than 45 degrees, a moving distance of the inner member 114 in the first direction X is small compared to the moving distance of the wedge member 115 in the second direction Z.

In addition, the wedge member 115 is connected to the driving unit 116 and configured to move linearly. Accordingly, the wedge member 115 finely adjusts the distance between the outer member 113 and the inner member 114.

Here, the driving unit 116 according to an embodiment of the present disclosure includes a step motor 116*b* and a screw rod 116*a* coupled to the step motor 116*b*. Further, the wedge member includes a through-hole 115*c* threaded in the second direction Z. In addition, the screw rod 116*a* is inserted into the through-hole 115*c* by screwing.

The moving distance of the wedge member 115 is finely adjusted according to the amount of rotation of the screw rod 116*a* rotated by the step motor 116*b*. Accordingly, a distance by which the inner member 114 moves in the first direction X is adjusted to 0.1 mm or less.

The variable die 100 may include a controller 130 controlling the first lower die portion 110. To this end, the controller 130 is connected to the first sensor unit 117, the second sensor unit 118, and the driving unit 116.

The controller 130 adjusts the correction distance by driving the driving unit 116 based on the forming distance B. More specifically, the controller 130 adjusts the correction distance based on a forming error value S, a difference between a target distance T, a distance between a product to be finally formed and the first sensor unit 117, and the forming distance B. The forming distance B and the target distance T may refer to the contents shown in FIG. 7. Here, the product to be finally formed has a final target shape of the material m.

The forming error value S includes springback value when the forming distance B is measured to be larger than the target distance T or a spring go value when the forming distance B is measured to be smaller than the set distance T. However, since springback occurs in most materials m, the following description is given based on the occurrence of springback.

The correction distance is adjusted to further overbend the material m by the value of the forming error due to springback. That is, when springback occurs in the material m, the controller 130 drives the driving unit 116 to move the inner member 114 in the first direction X to be close to the lower die center portion 111.

For example, after a first material is formed, the controller 130 moves the inner member 114 from a first position to a second position based on a forming error value S of the first material. At this time, since springback occurs in the first material, the second position may be closer to the first lower die center portion 111 than the first position.

Next, the controller 130 maintains the inner member 114 in the second position, while forming a second material that follows the first material. At this time, the second material is more over-bent than the first material. Accordingly, the forming distance B of the second material is partially converged to the target distance T and the forming error value S is reduced.

In addition, the controller 130 moves the inner member 114 from the second position to a third position based on the forming error value S of the second material after forming the second material. Therefore, the forming error value S of the third material that follows the second material is further reduced.

In this manner, the controller 130 continuously corrects the forming error value S of the repeatedly supplied material m. Accordingly, the forming error value S gradually decreases.

A pair of first lower die side parts 112 according to an embodiment of the present disclosure are provided on both sides of the first lower die center portion 111. Also, the controller 130 individually controls the driving unit. The driving unit 116 is individually controlled by the controller 130.

That is, a first side part 112*a* installed to be adjacent to one side of the first lower die center portion 111 and a second side part 112*b* installed to be adjacent to the other side of the first lower die center portion 111 are provided as a pair. Also, the driving unit 116 provided in the first side part 112*a* and the second side part 112*b* is individually driven by the controller 130. Accordingly, an interval between the inner member 114 provided in the first side part 112*a* and the second side part 112*b* and the first lower die center portion 111 is individually adjusted. In addition, the interval between the inner member 114 provided in the first side part 112*a* and the second side part 112*b* and the first lower die center portion 111 may be adjusted to be the same.

A first protruding tab 111*b* may be formed in an upper surface of the first lower die center portion 111 to be inserted into the position fixing hole ma formed in the material m.

Accordingly, a forming error due to a change in the position of the material m during forming of the material m may be improved.

The first protruding tab 111*b* and the position fixing hole ma corresponding to the first protruding tab 111*b* may be formed alone, but may be provided in plural to more stably fix the position of the material m.

The second sensor unit 118 is installed on the outer member 113. Accordingly, the second sensor unit 118 measures the amount of deformation of a distance between the inner member 114 and the outer member 113. The amount of deformation of the distance between the inner member 114 and the outer member 113 is equal to the correction distance.

With the second sensor unit 118 provided, the correction distance may be measured in real time.

The first upper die portion 120 cooperates with the first lower die portion 110 to form the material m. That is, the first upper die portion 120 is moved in the direction Y of the first lower die portion 110 to press and shape the material m. To this end, the first upper die portion 120 may be disposed above the first lower die portion 110.

Specifically, the first upper die portion 120 according to an embodiment of the present disclosure includes a first upper die center portion 121 and a first upper die side part 122.

The first upper die center portion 121 is disposed above the first lower die center portion 111 and moves downwardly toward the first lower die center portion 111. The first upper die side part 122 is installed on a side surface of the first upper die center portion 121 and moves downwardly to be guided by an inclined surface 114*a* of the inner member 114 and rotatably moved to a side surface of the first lower die center portion 111.

The first upper die center portion 121 cooperates with the first lower die center portion 111 to fix a central portion of the material m. The first upper die side part 122 forms the material m, while pressing both sides of the material m in the lateral direction X of the first lower die center portion 111.

A guide hole 121*a* is formed in an arc shape in the first upper die center portion 121. Also, the first upper die side part 122 includes a rotating pin member 122*a*. Here, when the first upper die side part 122 descends along the inclined surface 114*a*, the rotating pin member 122*a* moves along the guide hole 121*a*. Accordingly, the first upper die side part 122 rotates.

In addition, the first upper die side part 122 may include a return spring 122*b* a contraction spring. Both ends of the return spring 122*b* are coupled to the first upper die side part 122 and the first upper die center portion 121, respectively. Accordingly, when the first upper die portion 120 moves away from the first lower die portion 110, the first upper die side part 122 is driven to return to the original position, while leaving the inclined surface 114*a* of the first lower die side part 112.

Figure 6:
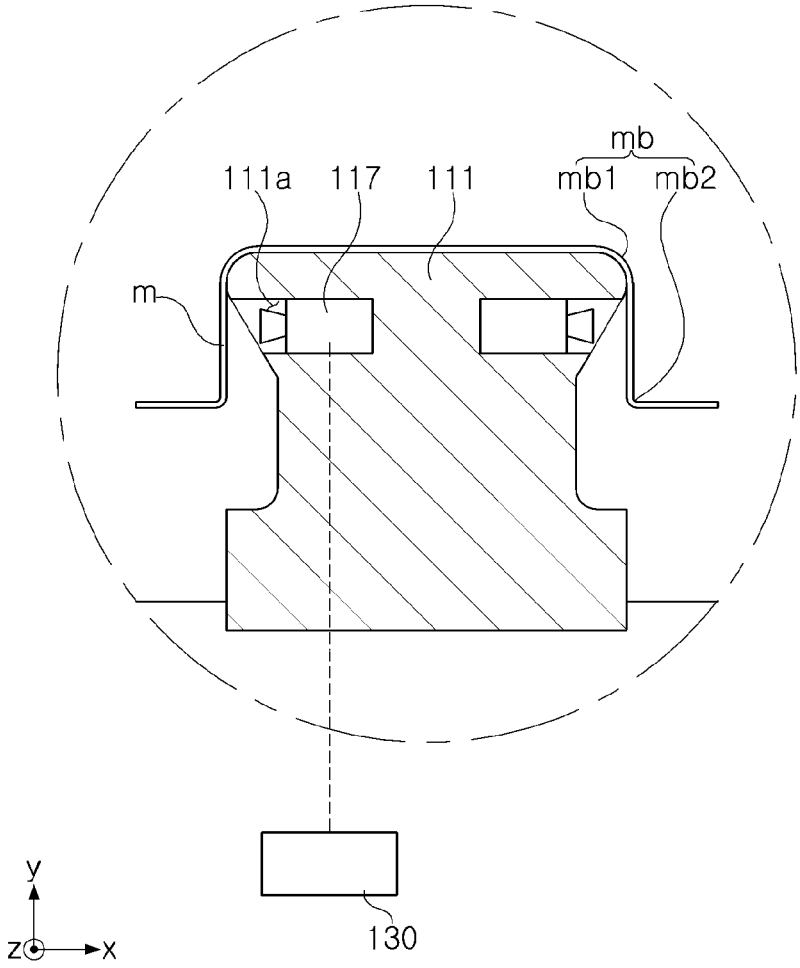
FIGS. 6 and 7 are front views illustrating a cross-section of a first lower die center portion according to an embodiment of the present disclosure.
Figure 7:
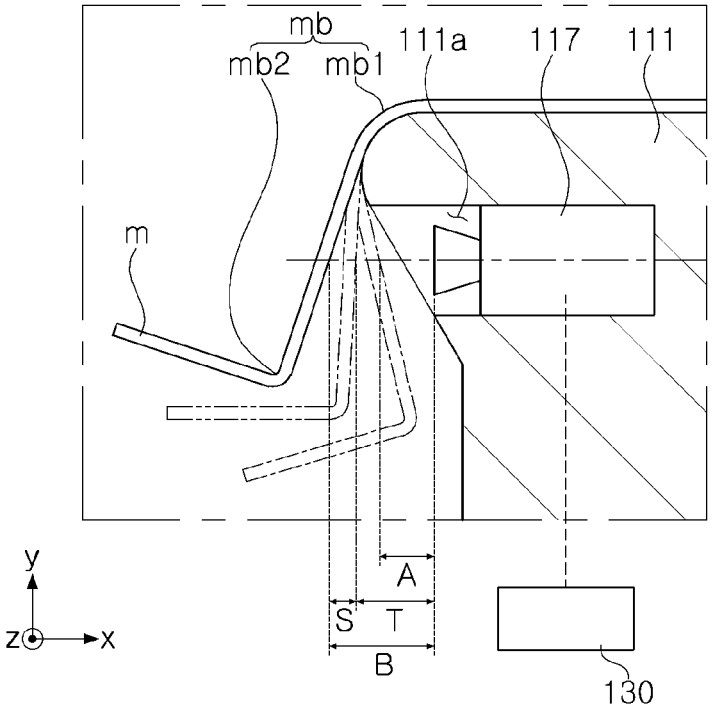

FIGS. 6 and 7 are front views illustrating a cross-section of the first lower die center portion 110 according to an embodiment of the present disclosure. That is, FIG. 6 illustrates all of the first sensor units 117 disposed toward both side surfaces of the first lower die center portion 111. In addition, FIG. 7 illustrates an enlarged view of only the first sensor unit 117 on one side, but illustrates a state in which forming errors occur due to springback of the material m.

Referring to the drawings, the first lower die center portion 111 according to an embodiment of the present disclosure includes an observation hole 111*a*. The observation hole 111*a* is formed on a side surface of the first lower die center portion 111 and is formed toward the material. In addition, the observation hole 111*a* is formed at a middle portion of the first lower die center portion 111 in the height direction Y. In addition, the first sensor unit 117 is disposed in the observation hole 111*a*.

Accordingly, the first sensor unit 117 is installed in the middle portion of the first lower die center portion 111 in the height direction Y.

The first sensor unit 117 may be provided as a pair to measure a distance toward both sides surfaces of the first lower die center portion 111. However, the present disclosure is not limited thereto and the first sensor unit 117 may be provided as a single unit to measure the distance toward one side surface of the first lower die center portion 111.

Also, since the first sensor unit 117 is provided in the middle portion of the first lower die center portion 111 in the height direction Y, a distance measurement error with respect to the material m may be reduced. That is, the material m is formed to include at least one bent portion mb. However, the bent portion mb is formed at an upper end portion or a lower end portion of the first lower die center portion 111. In addition, it is difficult to maintain flatness near the bent portion mb compared to other portions of the material m. Therefore, the first sensor unit 117 is provided in the middle portion of the first lower die center portion 111 in the height direction Y in which the influence of the bent portion mb is minimized. Accordingly, the first sensor unit 117 improves the forming distance B error due to a difference in flatness of the material m.

The first sensor unit 117 measures the forming distance B, the distance between the material m and the first sensor unit 117, through the observation hole 111*a*.

Figure 8:
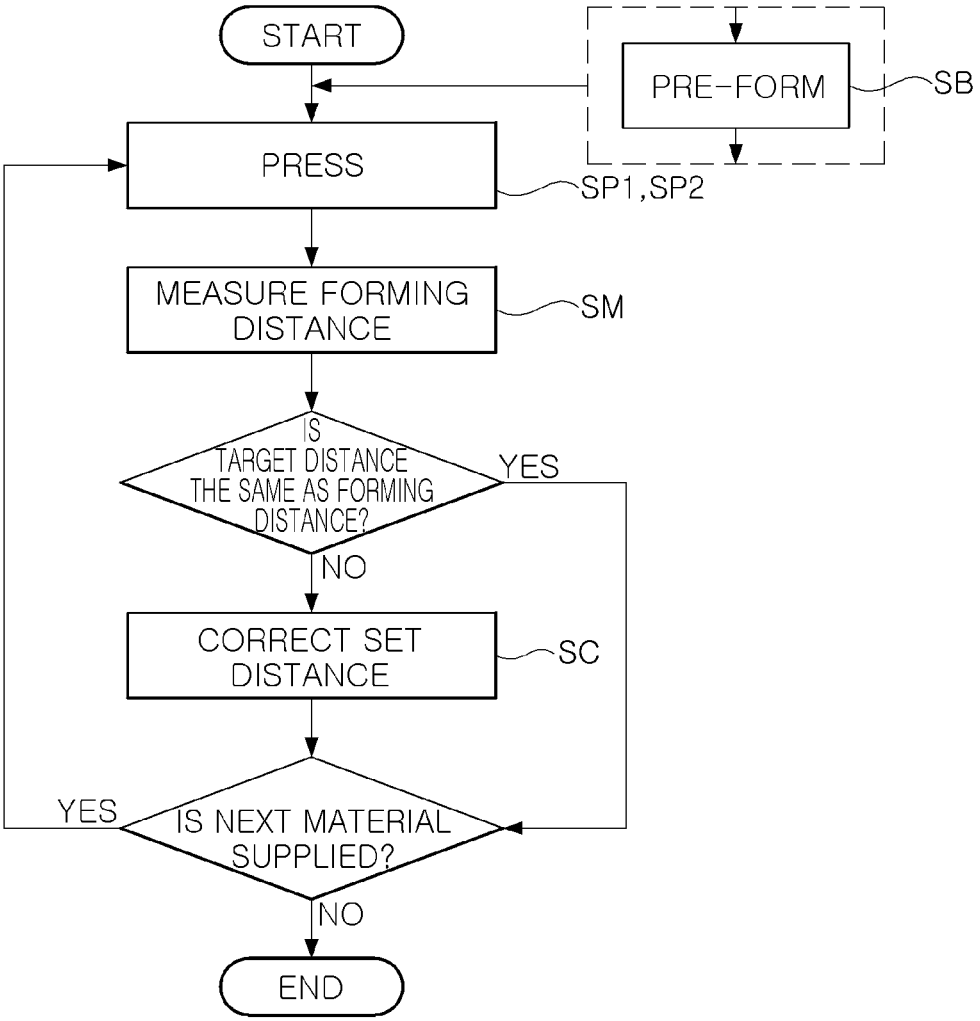
FIG. 8 is a flowchart illustrating a pressing method according to an embodiment of the present disclosure.

FIG. 8 is a flowchart illustrating a pressing method according to an embodiment of the present disclosure. The pressing method includes pressing operations SP1 and SP2, a forming distance measuring operation SM, and a set distance correcting operation SC. The pressing operations SP1 and SP2 include a first pressing operation SP1 and a second pressing operation SP2. The material includes a first material and a second material. The set distance A includes a first set distance $A_n$ and a second set distance $A_{n+1}$. The forming distance B includes a first forming distance $B_n$ and a second forming distance $B_{n+1}$.

Also, the first material is not limited to an initial material, and may be a material supplied after a plurality of pressing processes. The first set distance $A_n$ is not limited to an initial set distance $A_1$, and may be a set distance $A_n$ determined after a plurality of pressing processes. The first forming distance $B_n$ is not limited to an initial forming distance $B_1$, and may be a forming distance $B_n$ determined after a plurality of pressing processes.

Here, the first pressing operation SP1 is an operation of forming the first material with the variable die 100 under a forming condition determined by the first set distance $A_n$, a set distance $A_n$ of any one round. Here, the forming conditions of the variable die 100 is a position of the inner member 114 disposed based on the first set distance $A_n$.

The forming distance measuring operation SM is performed after the first pressing operation SP1. The forming distance measuring operation SM is an operation of measuring the first forming distance $B_n$, a distance between the first material and the first sensor unit 117 of the variable die 100. That is, in the forming distance measuring operation SM, the first forming distance $B_n$ is measured based on a shape of the first material after springback occurs due to forming.

The set distance correcting operation SC is performed after the forming distance measuring operation SM. The set distance correcting operation SC is an operation of determining a second set distance $A_{n+1}$, a set distance $A_{n+1}$ of a following round based on a difference between the first forming distance $B_n$ and the first set distance $A_n$.

However, when the target distance T, the distance between a product to be finally formed and the first sensor unit 117, and the first forming distance Bn are the same, the first set distance $A_n$ do not need to be corrected in the following round forming. Accordingly, when the target distance T and the first forming distance $B_n$ are the same, the set distance correcting operation SC may not be performed.

In addition, in the set distance correcting operation SC according to an embodiment of the present disclosure, the set distance $A_{n+1}$ of the following round is set by the following formula.

$$A_{n+1}=T+(An-Bn)$$

Here, A is the set distance. B is the forming distance. n is the number of repetitions and is "n=1, 2, 3, . . . ". T is the target distance, the distance between the product to be finally formed and the first sensor unit. And the first set distance $A_1$ is the same as the target distance T.

As an example, when the target distance T is 10 mm and the forming distance B1 measured in a first pressing process due to the occurrence of springback is 12 mm, the following is considered. At this time, the set distance $A_1$ is 10 mm because it is the same as the target distance T. According to this, the set distance $A_2$ of a second pressing process is determined to be 8 mm by the above formula.

If the forming distance $B_2$ measured in the second pressing process is 11 mm, a set distance $A_3$ in a third pressing process is determined to be 7 mm by the above formula. That is, the set distance $A_3$ of the third pressing process is determined to be smaller than the set distance $A_2$ of the second pressing process. The reason for this determination is because correction of a forming error due to springback is further required even with the correction based on the set distance of the second round.

In addition, when the forming distance $B_2$ measured in the second pressing process is 10 mm, the set distance $A_3$ in the third pressing process is determined to be 8 mm by the above formula. That is, the set distance $A_3$ of the third pressing process is determined to be the same as the set distance $A_2$ of the second pressing process. The reason for this determination is because the correction of the forming error due to springback is no longer necessary due to the correction by the set distance of the second round.

In addition, when the forming distance $B_2$ measured in the second pressing process is 9 mm, the set distance $A_3$ in the third pressing process is determined to be 9 mm by the above formula. That is, the set distance $A_3$ of the third pressing process is determined to be greater than the set distance $A_2$ of the second pressing process. The reason for this determination is because the correction by the set distance of the second round is too excessive even when springback is taken into consideration.

The second pressing operation SP2 is performed after the set distance correcting operation SC. The second pressing operation SP2 is an operation of forming a second material that follows the first material with the variable die 100 under a forming condition determined by the second set distance $A_{n+1}$. That is, the second pressing operation SP2 is the same as the first pressing operation SP1 in that a material is formed by press working, except that the second material, instead of the first material, is formed with the variable die under the forming condition determined by the second set distance $A_{n+1}$, instead of the first set distance $A_n$.

In addition, since the second pressing operation SP2 is performed when the second material is supplied, the second pressing operation SP2 is performed after checking whether the second material is supplied.

Therefore, after the second pressing operation SP2, the forming distance measuring operation SM, the set distance correcting operation SC, and the third pressing operation of working the third material that follows the second material may be continuously performed. That is, while the material is continuously supplied, the pressing method according to an embodiment of the present disclosure is continuously performed.

The changed forming condition of the variable die 100 is the position of the inner member 114 changed based on the second set distance $A_{n+1}$.

In addition, the pressing method according to an embodiment of the present disclosure may include a pre-forming operation SB. The pre-forming operation SB is performed before the first pressing operation SP1. Also, the pre-forming operation SB is an operation of forming the first material with the pre-die 300.

Therefore, the variable die 100, the pressing apparatus, and the pressing method according to an embodiment of the present disclosure may change forming conditions for correcting forming errors due to springback of the material m. Moreover, these forming conditions may be changed in real time.

Accordingly, the variable die 100, the pressing apparatus, and the pressing method according to an embodiment of the present disclosure automatically minimize forming errors due to springback regardless of the physical properties of the material m and the shape of the high-strength material before forming.

Although the embodiments of the present disclosure have been described above, the scope of the present disclosure is not limited thereto, and it is obvious to those skilled in the art that various modifications and variations may be made without departing from the scope of the present disclosure described in the claims.

DESCRIPTION OF REFERENCE CHARACTERS

100: Variable Die
110: First Lower Die Portion
111: First Lower Die Center Portion
112: First Lower Die Side Portion
113: Outer Member
114: Inner Member
115: Wedge Member
116: Driving Unit
117: First Sensor Unit
118: Second Sensor Unit
120: First Upper Die Portion
121: First Upper Die Center Portion
122: First Upper Die Side Part
200: Pressing Body
130: Controller
300: Pre-Die
310: Second Lower Die Portion
311: Second Lower Die Center Portion
312: Second Lower Die Side Part
320: Second Upper Die Portion
321: Second Upper Die Center Portion
322: Second Upper Die Side Part
400: Transfer Unit
500: Position Adjustment Block

The invention claimed is:

1. A variable die comprising:
a first lower die portion; and
a first upper die portion disposed above the first lower die portion,
wherein the first lower die portion includes:
a first lower die center portion, on which a material is seated, and including a first sensor unit; and
a first lower die side part installed on a side surface of the first lower die center portion,
the first lower die side part includes:
an inner member having an inclined surface close to the first lower die center portion from top to bottom; and
a driving unit moving the inner member in a first direction, the first direction is a direction toward the first lower die center portion,
the first upper die portion includes:
a first upper die center portion disposed above the first lower die center portion, and the first upper die center portion moving downwardly toward the first lower die center portion; and
a first upper die side part installed on a side surface of the first upper die center portion, the first upper die side part is moving downwardly guided by the inclined surface and rotatably moving to the side surface of the first lower die center portion, the first sensor unit measures a forming distance, the forming distance is a distance from the first sensor unit to the material, and the driving unit is driven based on the forming distance to adjust a correction distance, the correction distance is a moving distance of the inner member.

2. The variable die of claim 1, further comprising:

a controller controlling the first lower die portion, wherein the first lower die side part includes a second sensor unit measuring the correction distance, and the controller is connected to the first sensor unit, the second sensor unit, and the driving unit.

3. The variable die of claim 2, wherein the controller adjusts the correction distance based on a forming error value, the forming error value is a difference value between a target distance and the forming distance, and the target distance is a distance between a final product to be formed and the first sensor unit.

4. The variable die of claim 3, wherein the material includes a first material and a second material, the controller moves the inner member from a first position to a second position based on the forming error value of the first material after the first material is formed, holds the inner member in a second position, while forming the second material following the first material, and moves the inner member from the second position to a third position based on the forming error value of the second material after the second material is formed.

5. The variable die of claim 1, wherein the first lower die center portion includes an observation hole, the observation hole is formed (i) on the side surface of the first lower die center portion toward the material, and (ii) at a middle portion of the first lower die center portion in a height direction, and the first sensor unit is disposed in the observation hole.

6. The variable die of claim 1, wherein the first lower die side part further includes:

an outer member disposed outside the inner member; and a wedge member disposed between the inner member and the outer member, connected to the driving unit, and moved by the driving unit in a second direction, crossing the first direction, the wedge member includes:

an outer surface in contact with the outer member and formed to be horizontal to the second direction; and an inner surface in contact with the inner member and inclined in the second direction, and the inner member is moved in the first direction according to movement of the wedge member in the second direction.

7. The variable die of claim 6, wherein a wedge angle is formed to be smaller than at least 45 degrees.

8. The variable die of claim 6, wherein the driving unit includes:

a step motor; and a screw rod coupled to the step motor, the wedge member includes a through-hole having a screw thread in the second direction, and the screw rod is inserted into the through-hole by screwing.

9. The variable die of claim 2, wherein the first lower die side part is provided as a pair on both sides of the first lower die center portion, and the controller individually controls the driving unit.

10. The variable die of claim 1, wherein the first lower die center portion includes a first protruding tab formed on an upper surface thereof and the first protruding tab is inserted into a position fixing hole formed in the material.

11. A pressing apparatus comprising:

a pressing body;

a pre-die installed on the pressing body and primarily forming a material; and the variable die according to claim 1, installed on the pressing body and secondarily forming the material, while correcting a forming error caused by a springback of the material.

12. The pressing apparatus of claim 11, wherein the pre-die includes:

a second lower die portion in which the material is seated; and a second upper die portion disposed above the second lower die portion and moving downwardly toward the second lower die portion.

13. The pressing apparatus of claim 11, further comprising a position adjustment block installed on the pressing body and including a second protruding tab formed on an upper surface thereof, and the second protruding tab is inserted into a position fixing hole formed in the material.

14. The pressing apparatus of claim 13, further comprising a transfer unit installed on the pressing body, the transfer unit is configured to adsorb and fix the material, and sequentially move the material to the position adjustment block, the pre-die, and the variable die.

15. A pressing method comprising:

a first pressing operation of forming a first material with a variable die under a forming condition determined by a first set distance, $A_n$, where n is a number of repetitions;

a forming distance measuring operation of measuring a first forming distance, $B_n$, the first forming distance is a distance between the first material and a first sensor unit of the variable die;

a set distance correcting operation of determining a second set distance, $A_{n+1}$, the second set distance is a set distance for a following round, based on a difference between the first set distance and the first forming distance; and a second pressing operation of forming a second material following the first material with the variable die under a forming condition determined by the second set distance.

16. The pressing method of claim 15, wherein the set distance correcting operation determines the second set distance $A_{n+1}$ by the following formula:

$$A_{n+1}=T+(A_n-B_n)$$

wherein $A_n$ is the first set distance, $B_n$ is the first forming distance, n is the number of repetitions and "n=1, 2, 3, . . . ", and T is a target distance between a final product to be formed and the first sensor unit, and with the proviso that n is 1, the first set distance $A_1$ is the same as the target distance.

17. The pressing method of claim 15, further comprising a pre-forming operation of forming the first material with a pre-die, performed before the first pressing operation.

18. The pressing method of claim 15, wherein the variable die comprises:

a first lower die portion; and a first upper die portion disposed above the first lower die portion, wherein the first lower die portion includes:

a first lower die center portion, on which a material is seated, and including a first sensor unit; and a first lower die side part installed on a side surface of the first lower die center portion, the first lower die side part includes:

an inner member having an inclined surface close to the first lower die center portion from top to bottom; and a driving unit moving the inner member in a first direction, the first direction is a direction toward the first lower die center portion, the first upper die portion includes:

a first upper die center portion disposed above the first lower die center portion, and the first upper die center portion moving downwardly toward the first lower die center portion; and a first upper die side part installed on a side surface of the first upper die center portion, the first upper die side part is moving downwardly guided by the inclined surface and rotatably moving to the side surface of the first lower die center portion, the first sensor unit measures a forming distance, the forming distance is a distance from the first sensor unit to the material, and the driving unit is driven based on the forming distance to adjust a correction distance, the correction distance is a moving distance of the inner member.

* * * * *